US009550640B2

(12) United States Patent
Hayakawa

(10) Patent No.: US 9,550,640 B2
(45) Date of Patent: Jan. 24, 2017

(54) IMAGE FORMING APPARATUS AND SUPPLYING DEVICE

(71) Applicant: FUJI XEROX CO., LTD., Tokyo (JP)

(72) Inventor: Yuji Hayakawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/876,368

(22) Filed: Oct. 6, 2015

(65) Prior Publication Data

US 2016/0289020 A1 Oct. 6, 2016

(30) Foreign Application Priority Data

Apr. 3, 2015 (JP) ..... 2015-076502

(51) Int. Cl.
*B65H 1/08* (2006.01)
*B65H 3/06* (2006.01)
(Continued)

(52) U.S. Cl.
CPC *B65H 1/08* (2013.01); *B65H 1/14* (2013.01); *B65H 1/18* (2013.01); *B65H 1/266* (2013.01);
(Continued)

(58) Field of Classification Search
CPC ..... B65H 1/08; B65H 1/14; B65H 1/18; B65H 1/26; B65H 1/266; B65H 3/06; B65H 3/0661; B65H 3/0684; B65H 7/02; B65H 7/20; B65H 2405/1117; B65H 2405/11171; B65H 2405/31; B65H 2405/32; B65H 2405/35; B65H 2405/354
(Continued)

(56) References Cited

U.S. PATENT DOCUMENTS 5,228,676 A * 7/1993 Arai ..... G03G 15/6502 271/117
5,419,544 A * 5/1995 Ono ..... B65H 1/04 271/157
(Continued)

FOREIGN PATENT DOCUMENTS

JP H06-1469 A 1/1994
JP H06-173966 A 6/1994
JP H07-267385 A 10/1995

*Primary Examiner* — Prasad Gokhale
(74) *Attorney, Agent, or Firm* — Oliff PLC

(57) ABSTRACT

An image forming apparatus includes a storing-device body that is drawable from an image-forming-apparatus body, a supporting member attached to the storing-device body and that supports a stack of recording media from below, a feeding member that feeds a top one of the recording media on the supporting member into the image-forming-apparatus body, a moving mechanism that moves the supporting member such that the top one of the recording media on the supporting member comes into contact with the feeding member, a connecting mechanism that connects the moving mechanism to a drive source in conjunction with attaching of the storing-device body to the image-forming-apparatus body, an image forming section that forms an image on the recording medium fed by the feeding member, and a disabling mechanism that disables connection between the drive source and the moving mechanism in conjunction with pushing of the storing-device body into the image-forming-apparatus body.

6 Claims, 10 Drawing Sheets

(51) Int. Cl.

| | |
|---|---|
| ***B65H 1/26*** | (2006.01) |
| ***B65H 1/18*** | (2006.01) |
| ***B65H 1/14*** | (2006.01) |
| ***B65H 7/20*** | (2006.01) |
| ***B65H 7/02*** | (2006.01) |

(52) U.S. Cl.
CPC ..... *B65H 3/0661* (2013.01); *B65H 3/0684* (2013.01); *B65H 7/02* (2013.01); *B65H 7/20* (2013.01); *B65H 2405/1117* (2013.01)

(58) Field of Classification Search
USPC ..... 271/126, 127, 147, 152–155, 157, 162
See application file for complete search history.

(56) References Cited

U.S. PATENT DOCUMENTS

| | | | | |
|---|---|---|---|---|
| 5,775,686 | A * | 7/1998 | Miyake | B65H 1/266 271/127 |
| 7,497,434 | B2 * | 3/2009 | Park | B65H 1/14 271/126 |
| 8,348,258 | B2 * | 1/2013 | Kato | B65H 1/14 271/127 |
| 2005/0151314 | A1 * | 7/2005 | Park | B65H 1/14 271/121 |

* cited by examiner

IMAGE FORMING APPARATUS AND SUPPLYING DEVICE

CROSS-REFERENCE TO RELATED APPLICATIONS

This application is based on and claims priority under 35 USC 119 from Japanese Patent Application No. 2015-076502 filed Apr. 3, 2015.

BACKGROUND

Technical Field

The present invention relates to an image forming apparatus and a supplying device.

SUMMARY

According to an aspect of the present invention, there is provided an image forming apparatus including a storing-device body that is drawable from an image-forming-apparatus body, a supporting member attached to the storing-device body and that supports a stack of recording media from below, a feeding member that feeds a top one of the recording media on the supporting member into the image-forming-apparatus body, a moving mechanism that moves the supporting member such that the top one of the recording media on the supporting member comes into contact with the feeding member, a connecting mechanism that connects the moving mechanism to a drive source in conjunction with attaching of the storing-device body to the image-forming-apparatus body, an image forming section that forms an image on the recording medium fed by the feeding member, and a disabling mechanism that disables connection between the drive source and the moving mechanism in conjunction with pushing of the storing-device body into the image-forming-apparatus body.

BRIEF DESCRIPTION OF THE DRAWINGS

An exemplary embodiment of the present invention will be described in detail based on the following figures, wherein.

DETAILED DESCRIPTION

Figure 1:
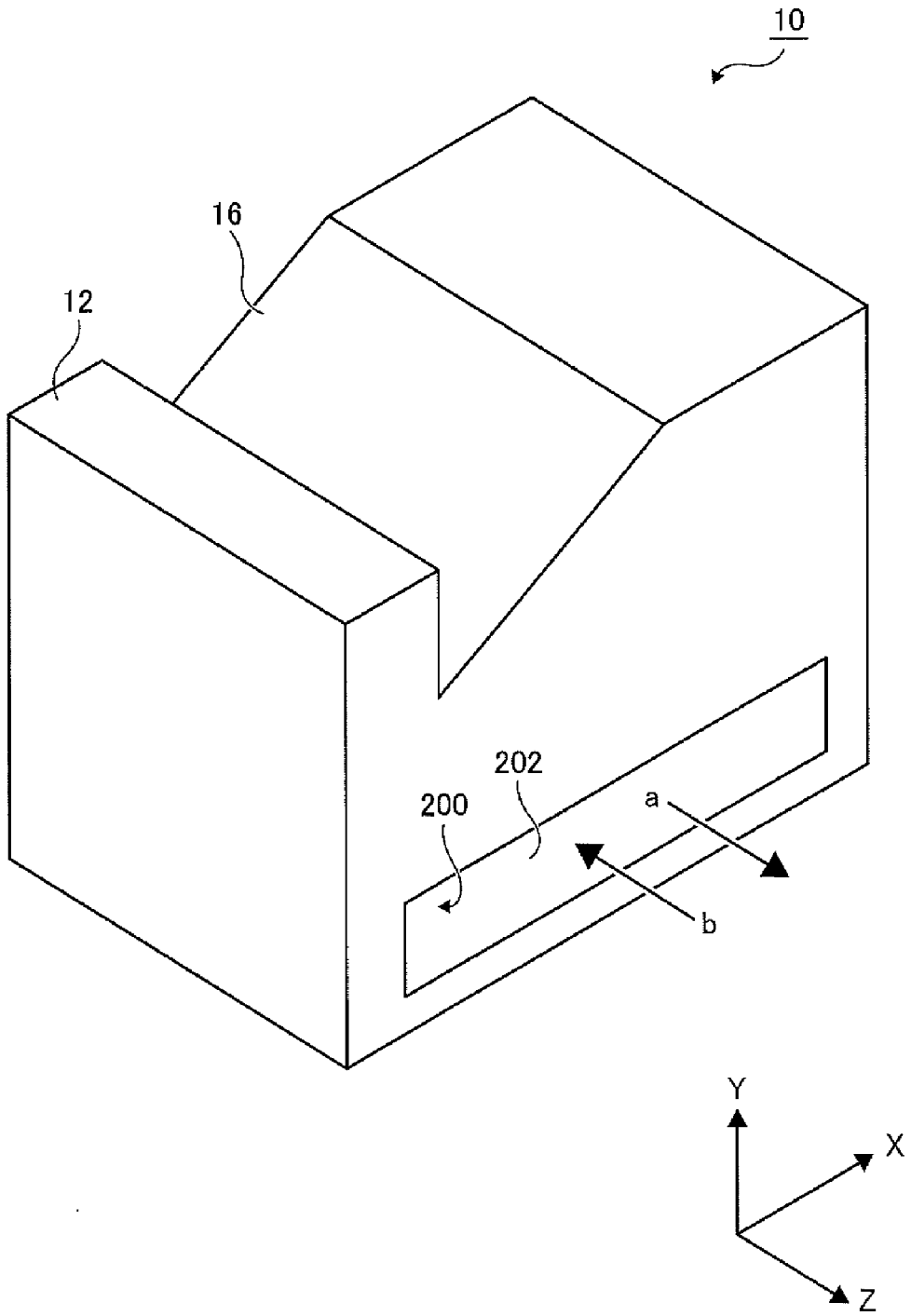
FIG. 1 is a schematic perspective view of an image forming apparatus according to the exemplary embodiment of the present invention.

FIG. 1 illustrates an image forming apparatus 10 according to an exemplary embodiment of the present invention. In the following description, a direction from the left side toward the right side of the image forming apparatus 10 is defined as the X-axis direction, a direction from the lower side toward the upper side of the image forming apparatus 10 is defined as the Y-axis direction, and a direction from the rear side toward the front side of the image forming apparatus 10 is defined as the Z-axis direction.

As illustrated in FIG. 1, the image forming apparatus 10 includes an image-forming-apparatus body 12. The image-forming-apparatus body 12 has a discharge portion 16 in the top surface thereof. Sheets are discharged onto the discharge portion 16. The sheets are each used as a recording medium and as a supply object.

The image-forming-apparatus body 12 is provided with a storing device 200 that stores sheets. The storing device 200 includes a storing-device body 202. The storing device 200 is drawable from the image-forming-apparatus body 12 toward the front side as indicated by arrow a and is attachable to the image-forming-apparatus body 12 by being pushed into the image-forming-apparatus body 12 toward the rear side as indicated by arrow b. The storing-device body 202 that is set in the image-forming-apparatus body 12 is allowed to be pushed further toward the rear side.

The storing-device body 202 has a handle in a portion thereof that is concealed from the outside in the state where the storing device 200 is set in the image-forming-apparatus body 12. Therefore, the image forming apparatus 10 has surfaces with few irregularities.

Figure 2:
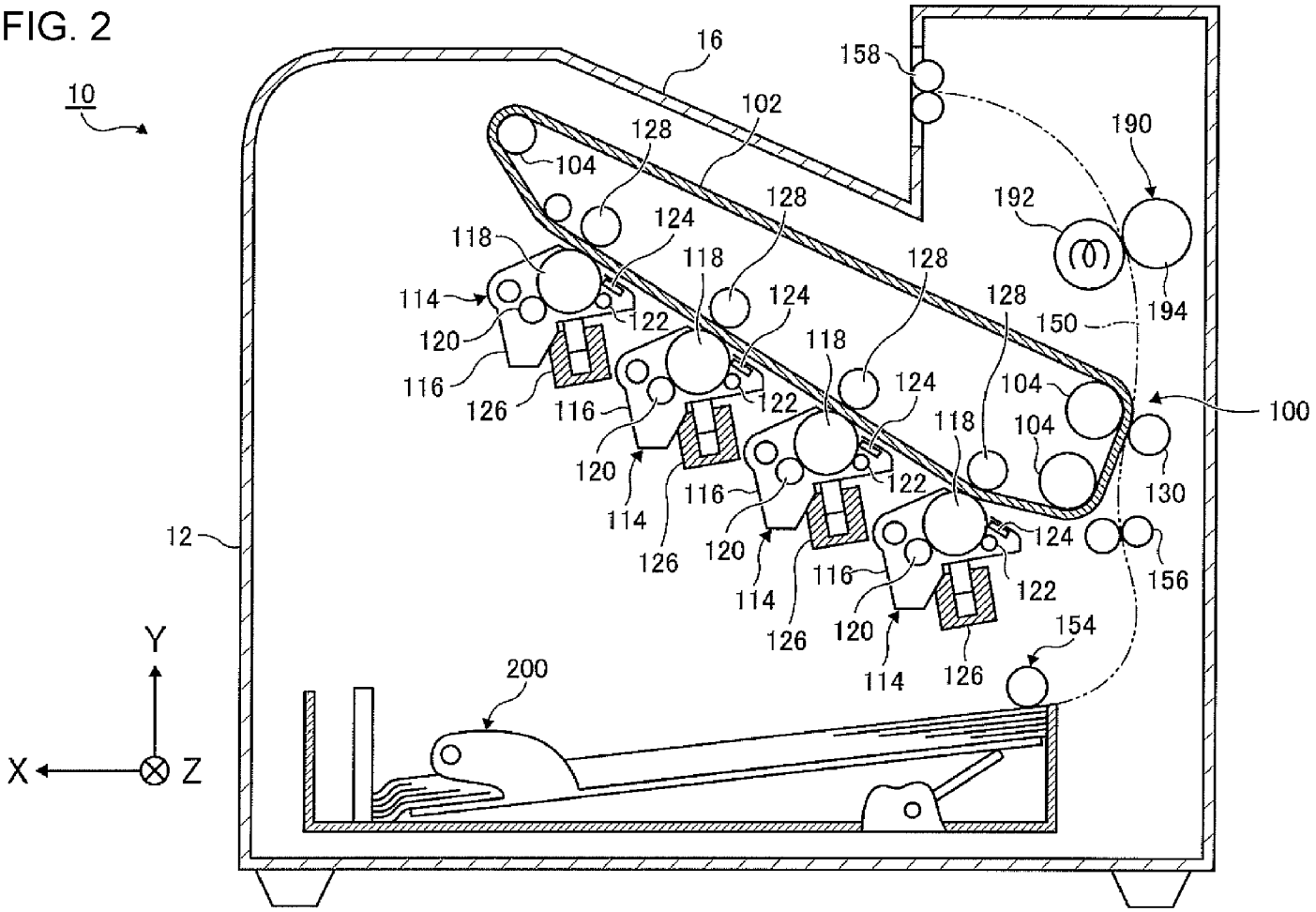
FIG. 2 is a schematic sectional view of the image forming apparatus illustrated in FIG. 1.

FIG. 2 is a sectional view of the image forming apparatus 10. As illustrated in FIG. 2, the image forming apparatus 10 includes an image forming section 100, a fixing device 190, and the storing device 200. A sheet transport path 150 runs through the image-forming-apparatus body 12.

The image forming section 100 employs, for example, an intermediate-transfer-belt method and includes an intermediate transfer belt 102. The intermediate transfer belt 102 is supported by plural supporting rollers 104 and rotates in, for example, a counterclockwise direction in FIG. 2. Four image forming units 114 for respective colors of, for example, cyan, magenta, yellow, and black are provided below the intermediate transfer belt 102.

The image forming units 114 each include a unit body 116, in which an image carrier 118, a developing device 120, a charging device 122, and a cleaning device 124 are provided. The image forming unit 114 further includes an optical writing device 126 facing the image carrier 118.

The image forming section 100 further includes first transfer rollers 128 and a second transfer roller 130. The first transfer rollers 128 are provided across the intermediate transfer belt 102 from the respective image carriers 118. The second transfer roller 130 is provided in the sheet transport path 150 and across the intermediate transfer belt 102 from one of the supporting rollers 104.

The optical writing devices 126 emit laser beams synchronously with color-image signals and thus form latent images on the image carriers 118 charged by the charging devices 122, respectively. The developing devices 120 develop the latent images on the image carriers 118 with developers into developer images, respectively. The developer images on the image carriers 118 are transferred to the intermediate transfer belt 102 by the first transfer rollers 128, respectively. The developer images thus transferred to the intermediate transfer belt 102 are transferred to a sheet by the second transfer roller 130. Developer particles remaining on the image carriers 118 are removed from the surfaces of the image carriers 118 by the cleaning devices 124, respectively.

The fixing device 190 includes, for example, a heating roller 192 and a pressing roller 194 and fixes the developers on the sheet with heat and pressure. The sheet having the developers fixed by the fixing device 190 is discharged onto the discharge portion 16 by a pair of discharge rollers 158.

The sheet transport path 150 is a transport path along which the sheet is transported from the storing device 200 to the discharge portion 16. The sheet transport path 150 is provided with, in order from the upstream side thereof, a pickup roller 154, a pair of registration rollers 156, the second transfer roller 130, the fixing device 190, and the pair of discharge rollers 158.

The pickup roller 154 is used as a feeding member and feeds the top one of the sheets supported by a supporting member 210 to be described below (see FIG. 3) into the sheet transport path 150. The pair of registration rollers 156 temporarily stops the transport of the sheet by coming into contact with the leading end of the sheet, and restarts the transport of the sheet synchronously with the arrival of the image on the intermediate transfer belt 102 at the second transfer roller 130.

Figure 3:
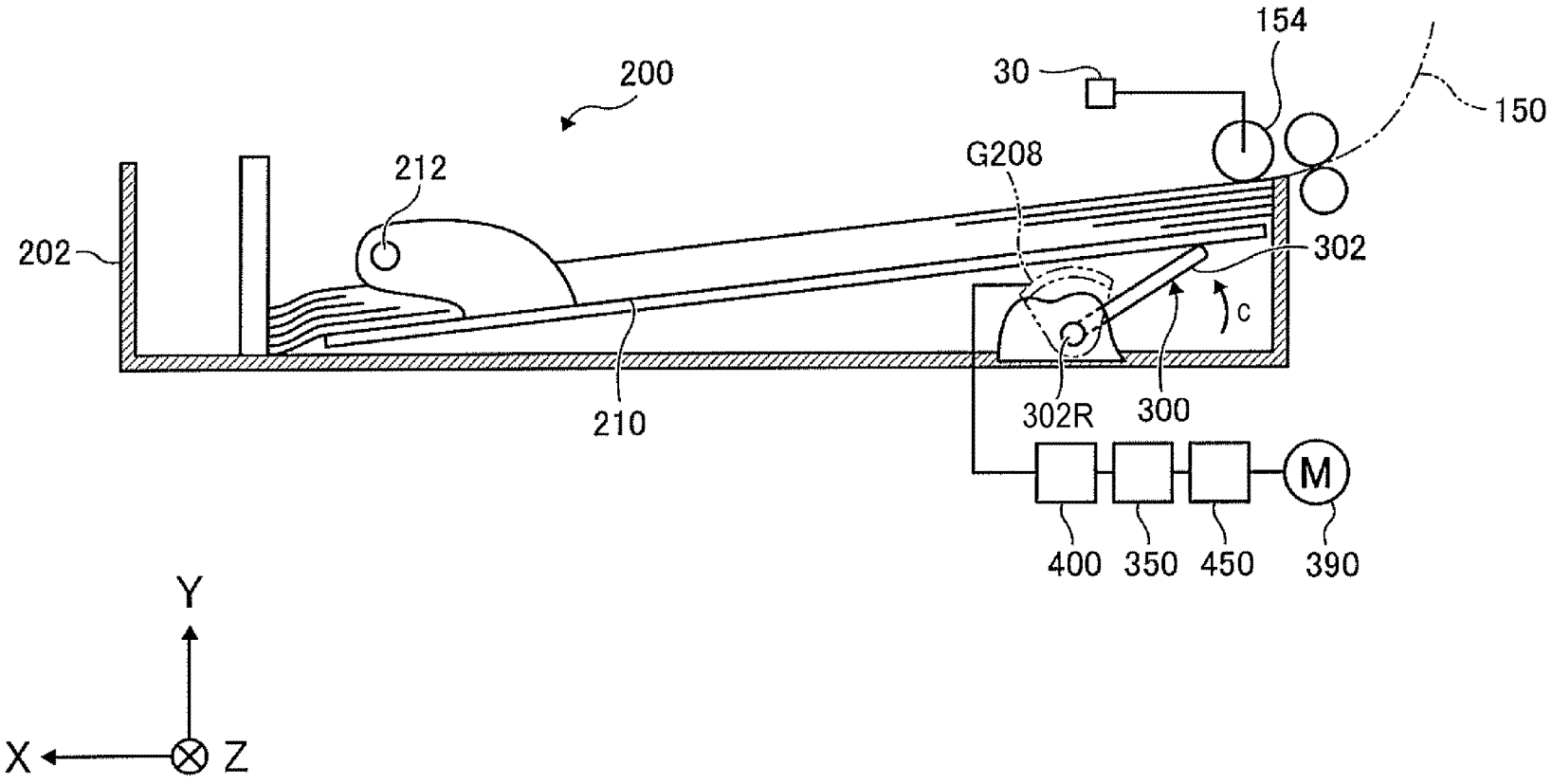
FIG. 3 is a schematic sectional view of a storing device included in the image forming apparatus illustrated in FIG. 1.
Figure 4:
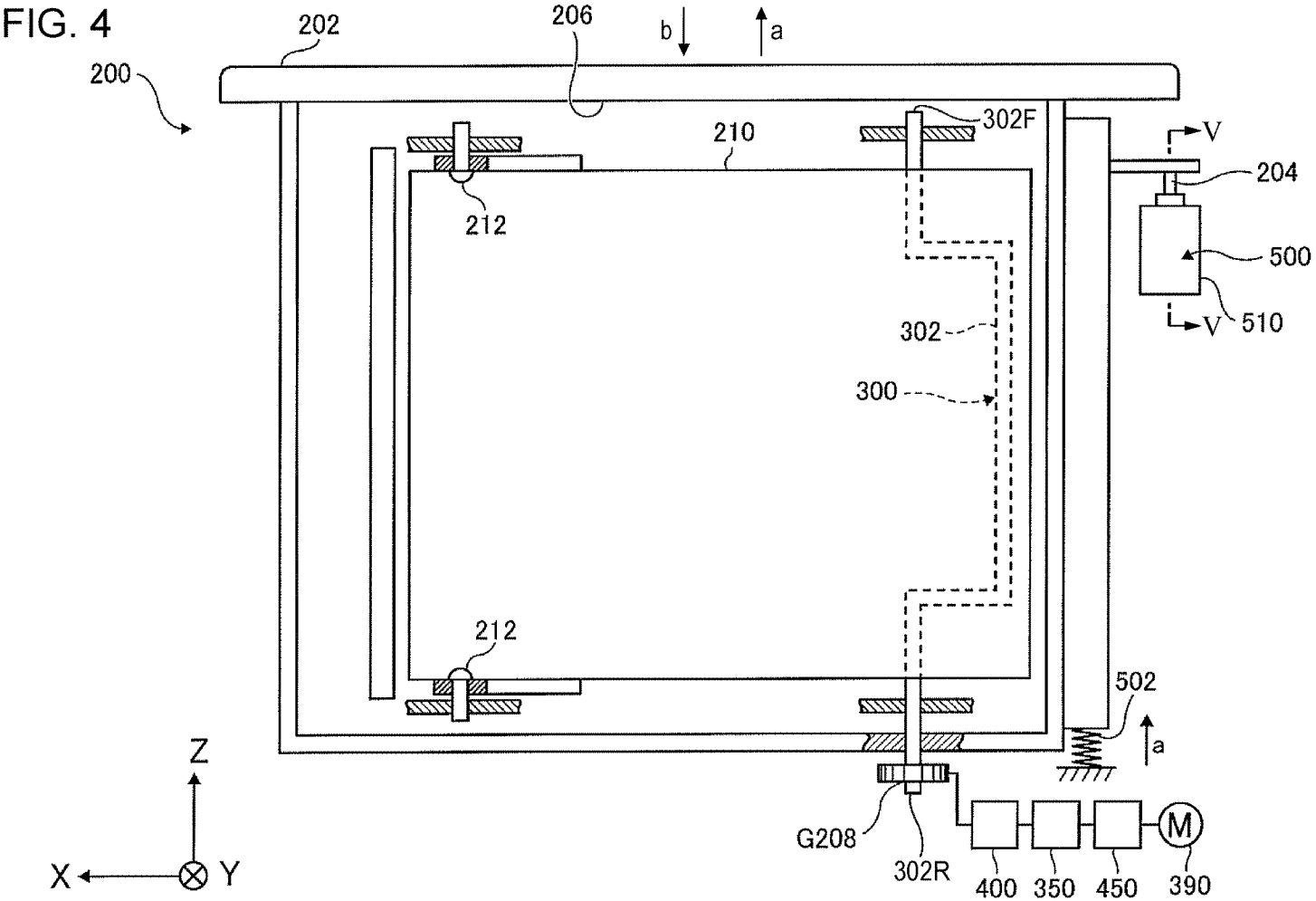
FIG. 4 is a schematic plan view of the storing device illustrated in FIG. 3.

FIGS. 3 and 4 illustrates the storing device 200. FIG. 3 illustrates the storing device 200 with some sheets stored therein. For the convenience of illustration, FIG. 4 illustrates the storing device 200 with no sheets stored therein.

As illustrated in FIGS. 3 and 4, the storing device 200 includes the storing-device body 202 and the supporting member 210. The supporting member 210 is attached to the storing-device body 202 in such a manner as to be turnable about two shaft members 212 and supports a stack of sheets from below. The top one of the sheets on the supporting member 210 is fed into the sheet transport path 150 by the pickup roller 154.

The storing device 200 is provided with a moving mechanism 300. The moving mechanism 300 moves the supporting member 210 such that the top one of the sheets supported by the supporting member 210 comes into contact with the pickup roller 154. The moving mechanism 300 includes a lifting member 302. The lifting member 302 may be, for example, a bent stick-like member. The lifting member 302 has a rear end 302R and a front end 302F that are attached to the storing-device body 202, and is rotatable with respect to the storing-device body 202.

The lifting member 302 comes into contact with the lower surface of the supporting member 210 by rotating in a direction of arrow c illustrated in FIG. 3 and lifts the left side of the supporting member 210. The lifting member 302 is provided with, for example, a sector-shaped gear G208 at the rear end 302R thereof. A driving force is transmitted from a motor 390, which is used as a drive source, to the lifting member 302 via the gear G208. The motor 390 is provided to the image-forming-apparatus body 12.

Furthermore, the image forming apparatus 10 includes a sensor 30 used as a contact detecting device. The sensor 30 detects the contact of the top one of the sheets supported by the supporting member 210 with the pickup roller 154.

A portion on the inner side of a front board of the storing-device body 202 is used as a handle 206. That is, the handle 206 is provided at a position that is handleable only when the storing-device body 202 is out of the image-forming-apparatus body 12.

Furthermore, the image forming apparatus 10 includes a connecting mechanism 350, a connection disabling mechanism 400, a disallowing mechanism 450, and a pushing mechanism 500.

The connecting mechanism 350 connects the moving mechanism 300 to the motor 390 in conjunction with the attaching of the storing-device body 202 to the image-forming-apparatus body 12, that is, in conjunction with the movement of the storing-device body 202 in the direction of arrow b. Details of the connecting mechanism 350 will be described later.

The connection disabling mechanism 400 disables the connection between the motor 390 and the moving mechanism 300 in conjunction with the pushing of the storing-device body 202 that is set in the image-forming-apparatus body 12 further into the image-forming-apparatus body 12, that is, in conjunction with the movement of the storing-device body 202 that is set in the image-forming-apparatus body 12 further in the direction of arrow b. Details of the connection disabling mechanism 400 will be described later.

The disallowing mechanism 450 allows the transmission of a rotational force from the side of the motor 390 toward the side of the moving mechanism 300 but disallows the transmission of the rotational force from the side of the moving mechanism 300 toward the side of the motor 390. Details of the disallowing mechanism 450 will be described later.

In the image forming apparatus 10, the driving force generated by the motor 390 provided to the image-forming-apparatus body 12 is transmitted to the moving mechanism 300 via the disallowing mechanism 450, the connecting mechanism 350, and the connection disabling mechanism 400.

The pushing mechanism 500 pushes the storing-device body 202 in a direction in which the storing-device body 202 is drawn out of the image-forming-apparatus body 12 in conjunction with the pushing of the storing-device body 202 that is set in the image-forming-apparatus body 12 further into the image-forming-apparatus body 12, that is, in conjunction with the movement of the storing-device body 202 that is set in the image-forming-apparatus body 12 further in the direction of arrow b.

The pushing mechanism 500 includes an urging member 502 that urges the storing-device body 202 toward the front side, and a stopping device 510 that stops the storing-device body 202 against the urging by the urging member 502 and retains the storing-device body 202 at the position in the image-forming-apparatus body 12. The urging member 502 may be an elastic member such as a coil spring.

The stopping device 510 may be, for example, a mechanism that pinches a projecting portion 204 projecting from the storing-device body 202 toward the rear side and thus stops the storing-device body 202 from moving toward the front side.

Figure 5A:
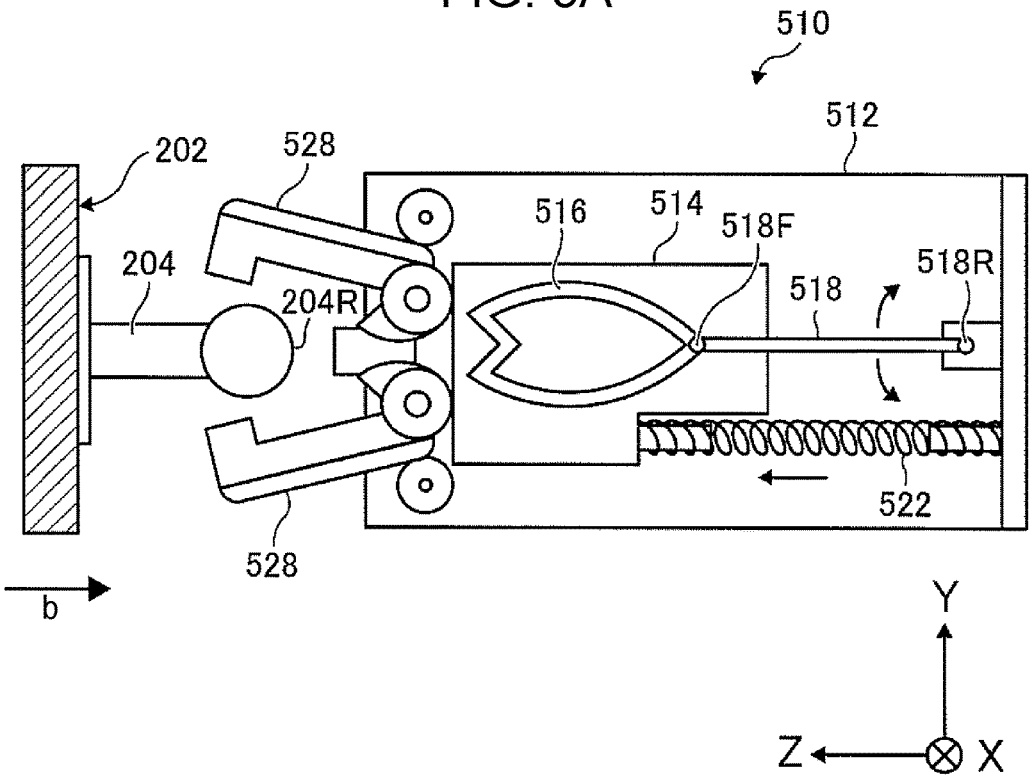
FIG. 5A is a sectional view of a stopping device included in the image forming apparatus illustrated in FIG. 1 that is taken along line V-V illustrated in FIG. 4 and illustrates a state where a storing-device body is not stopped from moving frontward.
Figure 5B:
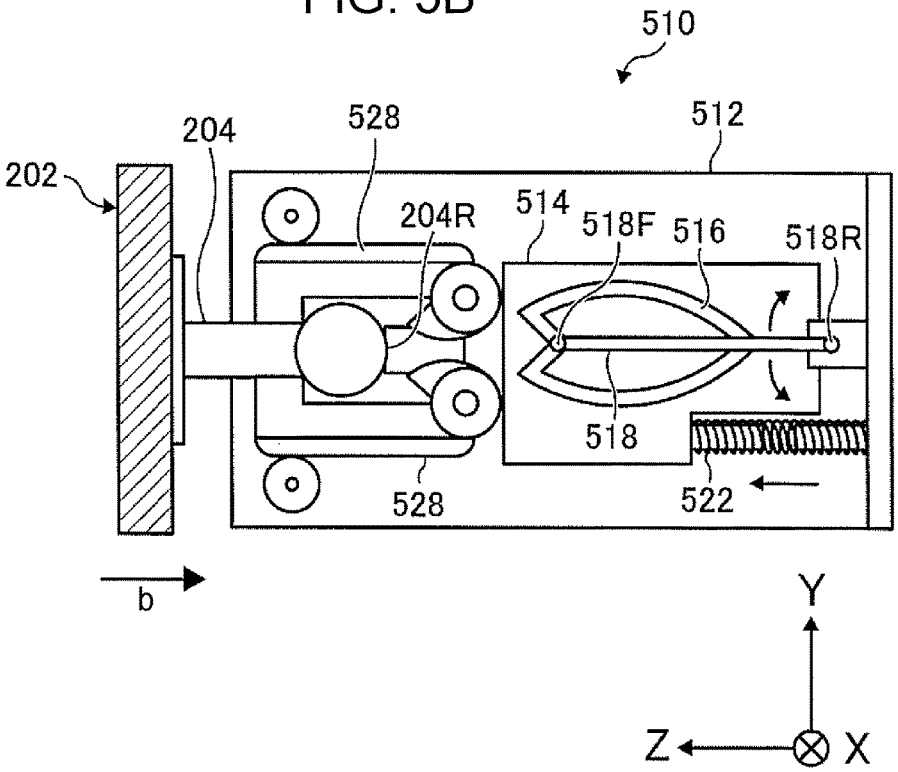
FIG. 5B is a sectional view of the stopping device included in the image forming apparatus illustrated in FIG. 1 that is taken along line V-V illustrated in FIG. 4 and illustrates a state where the storing-device body is stopped from moving frontward.

FIGS. 5A and 5B illustrate the stopping device 510. As illustrated in FIGS. 5A and 5B, the stopping device 510 includes a stopping-device body 512 and a movable member 514. The movable member 514 is attached to the stopping-device body 512 in such a manner as to be movable in the anteroposterior direction (the Z-axis direction). The movable member 514 is provided with a guiding portion 516. The guiding portion 516 has a heart shape by, for example, being grooved. The guiding portion 516 guides a swingable member 518.

A rear end 518R of the swingable member 518 is attached to the stopping-device body 512 such that the swingable member 518 is swingable about the rear end 518R with respect to the stopping-device body 512. A front end 518F of the swingable member 518 is movable by being guided along the guiding portion 516.

The stopping device 510 further includes an urging member 522 that urges the movable member 514 toward the front side. The front end of the urging member 522 is attached to the movable member 514. The rear end of the urging member 522 is attached to the stopping-device body 512.

The stopping device 510 includes two pinching members 528. The pinching members 528 are attached to the stopping-device body 512 at the rear ends thereof. The pinching members 528 are movable in the anteroposterior direction relative to the stopping-device body 512 and are rotatable about the rear ends thereof with respect to the stopping-device body 512. The two pinching members 528 are movable as a unit between a position illustrated in FIG. 5B (and in FIG. 4 also) where the projecting portion 204 is pinched therebetween and a position illustrated in FIG. 5A where the projecting portion 204 is not pinched therebetween.

When the pinching members 528 that are at the position illustrated in FIG. 5A are pushed rearward by a rear end 204R of the projecting portion 204, the pinching members 528 move to the position illustrated in FIG. 5B. When the pinching members 528 that are at the position illustrated in FIG. 5B are pushed further rearward by the rear end 204R of the projecting portion 204, the pinching members 528 are pushed frontward by the movable member 514 that is urged frontward by the urging member 522 and are moved to the position illustrated in FIG. 5A.

When the storing-device body 202 is out of the image-forming-apparatus body 12, the stopping device 510 is in the state illustrated in FIG. 5A. When the storing-device body 202 is set in the image-forming-apparatus body 12, the stopping device 510 is in the state illustrated in FIG. 5B, in which the stopping device 510 acts against the urging by the urging member 502 (see FIG. 4) and stops the storing-device body 202 from moving frontward, that is, the storing-device body 202 is retained at the position in the image-forming-apparatus body 12.

In the stopping device 510 configured as described above, when the storing-device body 202 is attached to the image-forming-apparatus body 12, the two pinching members 528 are pushed rearward by the rear end 204R of the projecting portion 204 and pinch the projecting portion 204 of the storing-device body 202 therebetween. Thus, the storing-device body 202 is stopped at the position in the image-forming-apparatus body 12 against the urging by the urging member 502. Furthermore, in the stopping device 510 configured as described above, when the storing-device body 202 that is set in the image-forming-apparatus body 12 is pushed rearward, the two pinching members 528 are pushed frontward by the movable member 514 and move to the position illustrated in FIG. 5A, where the pinching members 528 release the projecting portion 204. Accordingly, the storing-device body 202 that is urged by the urging member 502 is pushed frontward and goes out of the image-forming-apparatus body 12.

Figure 6:
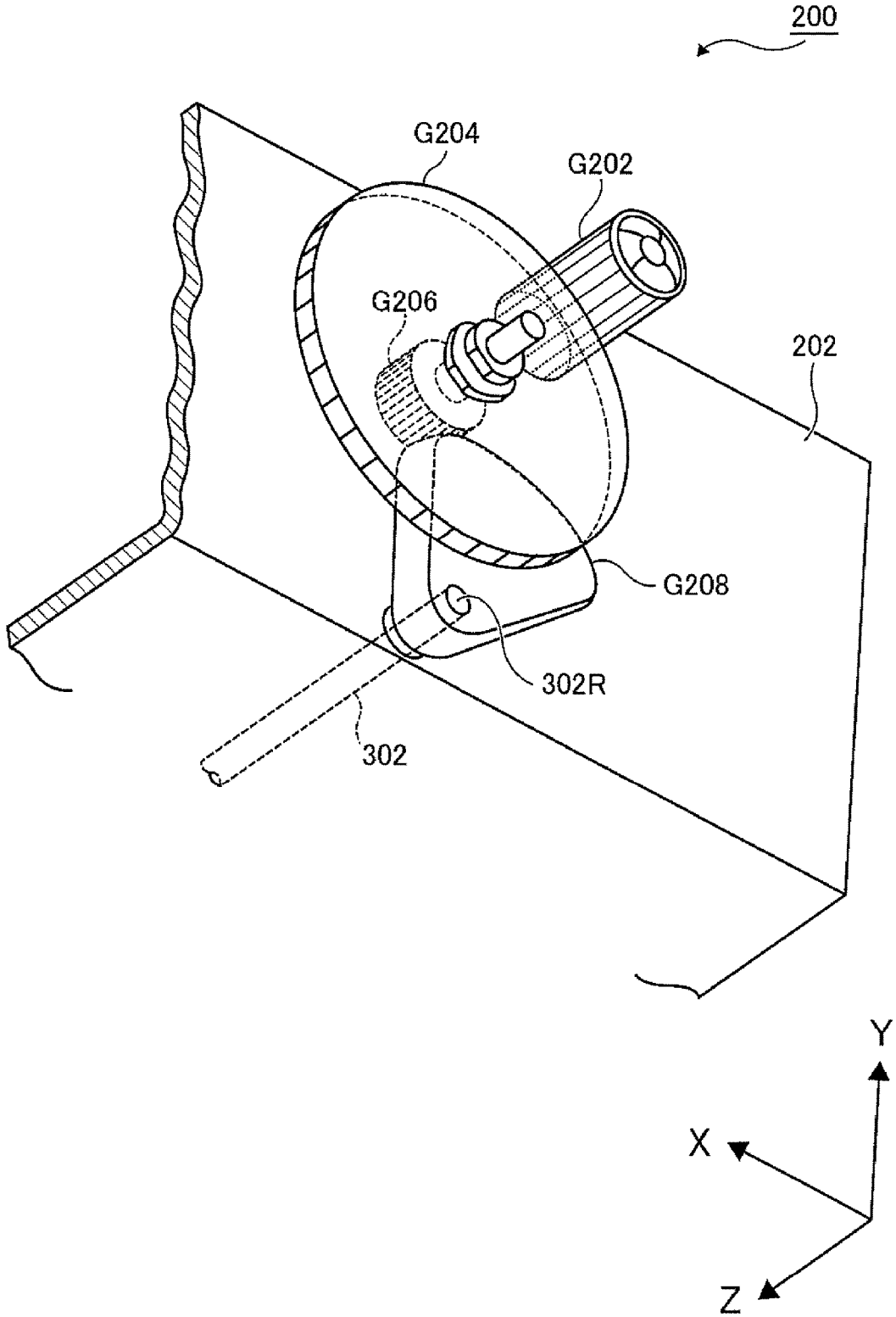
FIG. 6 is an enlarged view of a part of the storing device illustrated in FIG. 3.

FIG. 6 is an enlarged view of a part of the storing device 200. As described above, the storing-device body 202 is provided with the lifting member 302, and the lifting member 302 is provided with the gear G208 at the rear end 302R thereof. Furthermore, the storing-device body 202 is provided with a coupling gear G206, a coupling gear G204, and a coupling gear G202. The coupling gear G206 is in mesh with the gear G208 and transmits the driving force to the gear G208.

Figure 7:
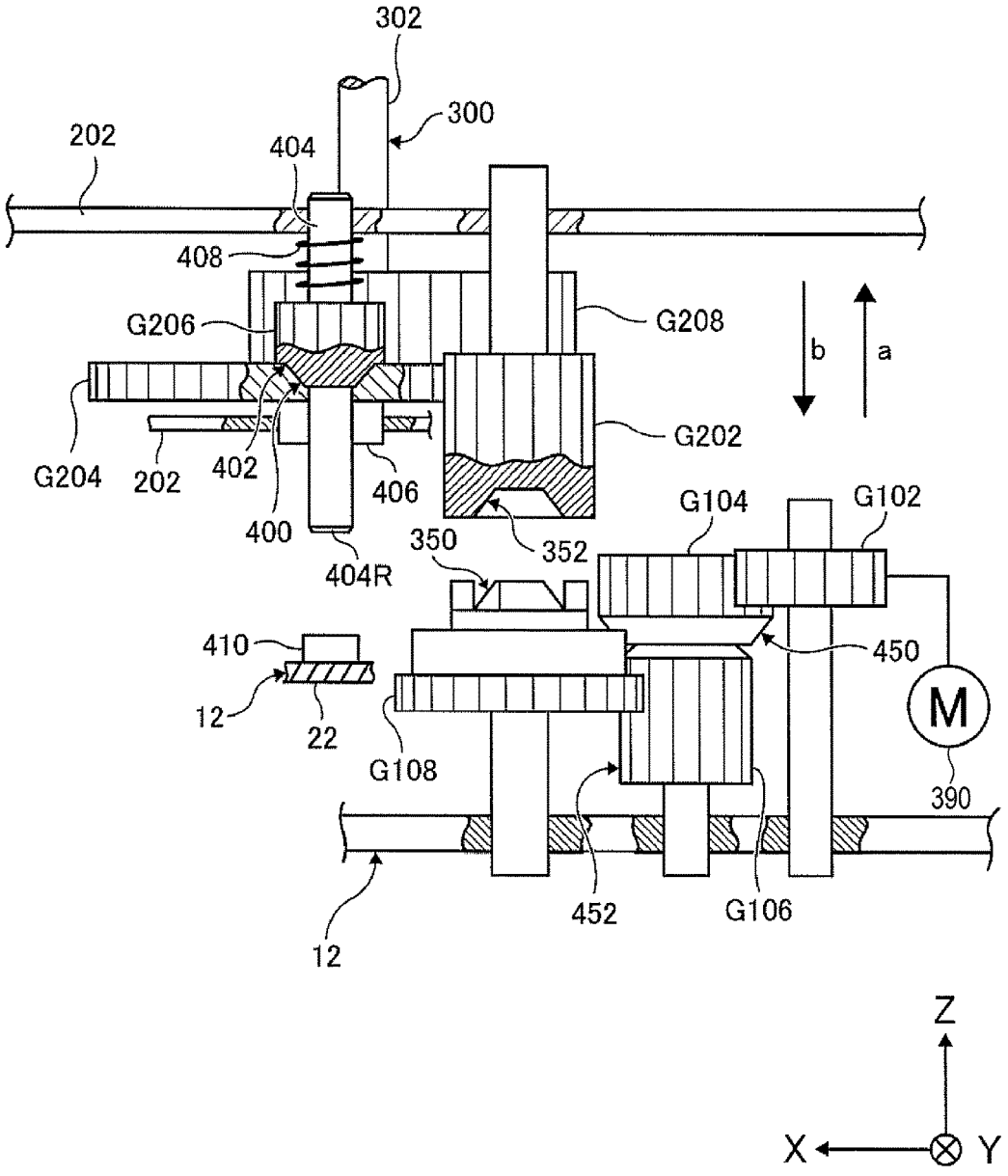
FIG. 7 is a first diagram illustrating a connecting mechanism, a connection disabling mechanism, and a disallowing mechanism included in the image forming apparatus illustrated in FIG. 1.
Figure 8:
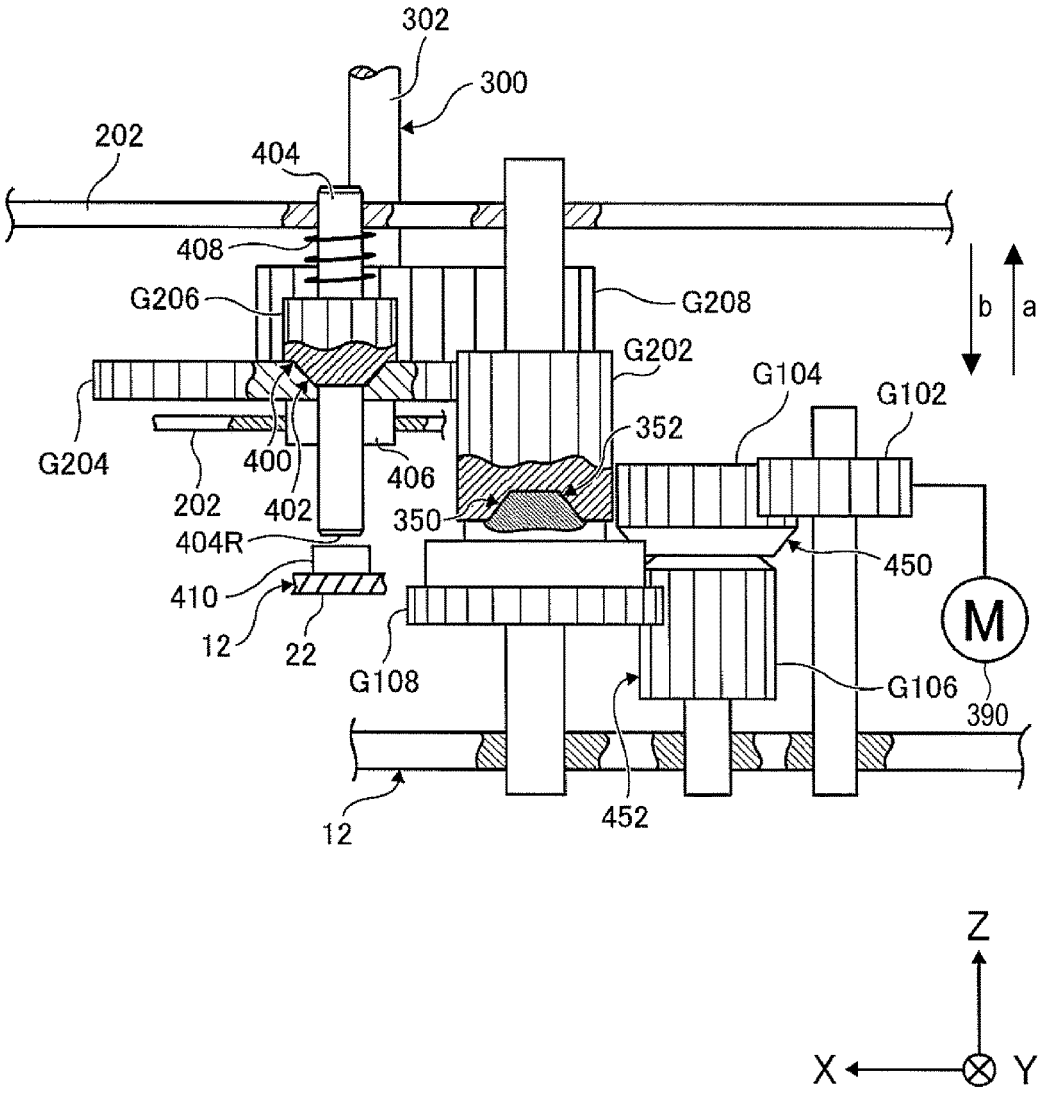
FIG. 8 is a second diagram illustrating the connecting mechanism, the connection disabling mechanism, and the disallowing mechanism included in the image forming apparatus illustrated in FIG. 1.
Figure 9:
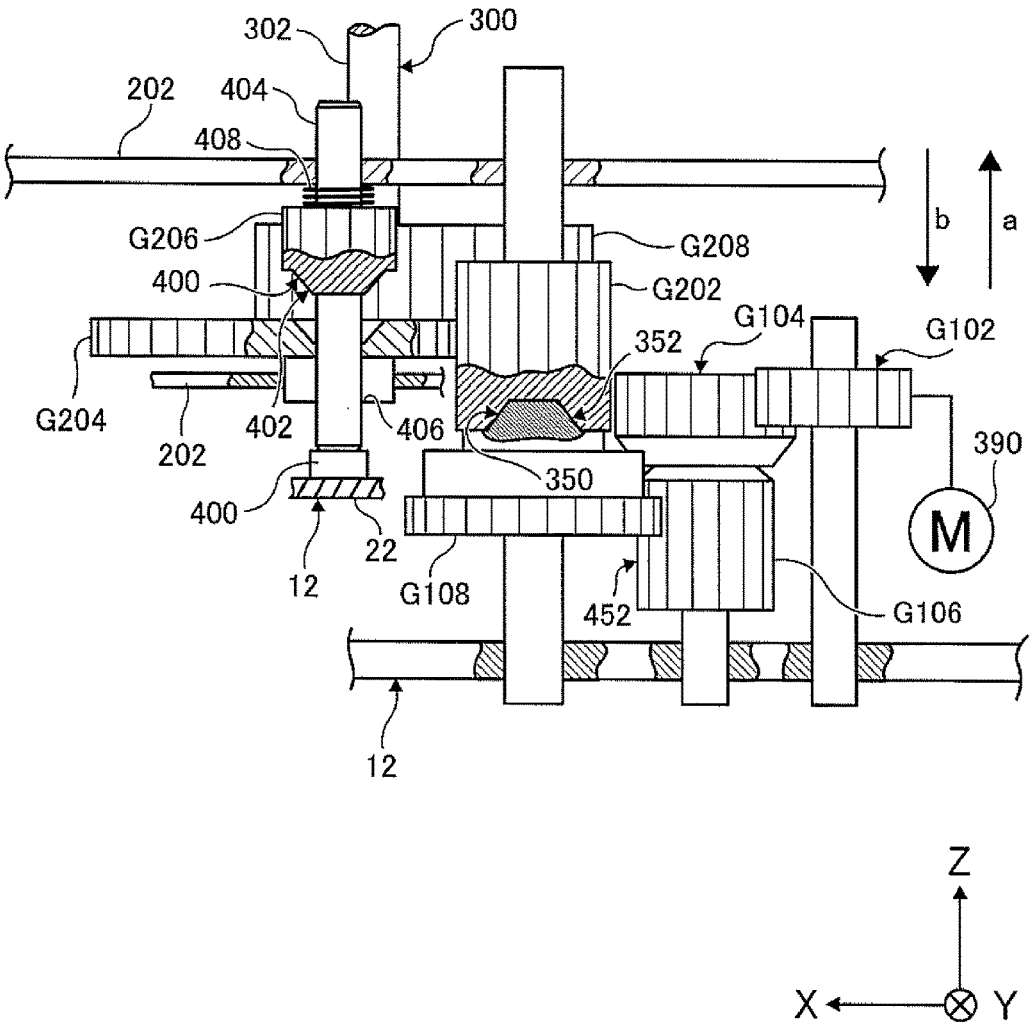
FIG. 9 is a third diagram illustrating the connecting mechanism, the connection disabling mechanism, and the disallowing mechanism included in the image forming apparatus illustrated in FIG. 1.

The coupling gear G204 and the coupling gear G206 constitute a first coupling mechanism 402 (see FIGS. 7 to 9). Specifically, the driving force is allowed to be transmitted from the coupling gear G204 to the coupling gear G206 when the coupling gear G204 is connected to the coupling gear G206, whereas the transmission of the driving force from the coupling gear G204 to the coupling gear G206 is disabled when the coupling gear G204 is disconnected from the coupling gear G206.

The coupling gear G202 is in mesh with the coupling gear G204 and transmits the driving force to the coupling gear G204. Furthermore, the coupling gear G202 and a coupling gear G108 to be described later (see FIGS. 7 to 9) constitute a second coupling mechanism 352 (see FIGS. 7 to 9). Specifically, the driving force is allowed to be transmitted from the coupling gear G108 to the coupling gear G202 when the coupling gear G202 is connected to the coupling gear G108, whereas the transmission of the driving force from the coupling gear G108 to the coupling gear G202 is disabled when the coupling gear G202 is disconnected from the coupling gear G108.

FIGS. 7, 8, and 9 illustrate the coupling gear G202, the coupling gear G204, the coupling gear G206, the gear G208, the connecting mechanism 350, the connection disabling mechanism 400, and the disallowing mechanism 450. FIG. 7 illustrates a state immediately before the storing-device body 202 is completely attached to the image-forming-apparatus body 12. FIG. 8 illustrates a state where the storing-device body 202 has been completely attached to the image-forming-apparatus body 12. FIG. 9 illustrates a state where the storing-device body 202 that has been attached to the image-forming-apparatus body 12 is further pushed into the image-forming-apparatus body 12.

As illustrated in FIGS. 7, 8, and 9, the coupling gear G206 is attached to the storing-device body 202 in such a manner as to be movable relative thereto in the direction of arrow a and in the direction of arrow b. More specifically, the coupling gear G206 includes a shaft 404, and the shaft 404 is attached to the storing-device body 202 in such a manner as to be movable relative thereto in the anteroposterior direction.

The coupling gear G204 is attached to the storing-device body 202 with a bearing 406 that is fixed to the storing-device body 202. Therefore, the coupling gear G204 is not movable relative to the storing-device body 202 in the anteroposterior direction. As with the coupling gear G204, the gear G208 and the coupling gear G202 are not movable relative to the storing-device body 202 in the anteroposterior direction.

The coupling gear G206 is provided with an urging member 408, which may be an elastic member such as a coil spring. The coupling gear G206 is urged toward the coupling gear G204 by the urging member 408. A stopping portion 410 with which a rear end 404R of the shaft 404 is to come into contact is provided on a side plate 22, which is a part of the image-forming-apparatus body 12.

As described above, the coupling gear G206 and the coupling gear G204 constitute the first coupling mechanism 402, and the first coupling mechanism 402 constitutes the connection disabling mechanism 400. In the connection disabling mechanism 400, when the storing-device body 202 that is set in the image-forming-apparatus body 12 as illustrated in FIG. 8 is further pushed rearward, the shaft 404 of the coupling gear G206 comes into contact with the stopping portion 410 and is stopped from moving rearward, whereas the coupling gear G204 moves rearward along with the storing-device body 202. That is, as illustrated in FIG. 9, the coupling gear G204 and the coupling gear G206 are spaced apart from each other, whereby the connection between the motor 390 and the moving mechanism 300 is disabled.

In the first coupling mechanism 402, the coupling gear G206 and the coupling gear G204 each have a tapered surface that is inclined with respect to the direction of arrow a and the direction of arrow b. When the coupling gear G206 and the coupling gear G204 come to be connected to each other, the tapered surface of the coupling gear G206 is guided by the tapered surface of the coupling gear G204. Such a configuration suppresses the occurrence of a connection error between the coupling gear G206 and the coupling gear G204 due to any phase shift that may occur in a case where the first coupling mechanism 402 includes a pin and a groove that receives the pin.

The storing-device body 202 is provided with the gear G208, the coupling gear G206, the coupling gear G204, and the coupling gear G202. The image-forming-apparatus body 12 is provided with the coupling gear G108, a one-way-clutch gear G106, a one-way-clutch gear G104, and a gear G102.

The one-way-clutch gear G106 is in mesh with the coupling gear G108. The driving force generated by the motor 390 is transmitted to the coupling gear G108 via the one-way-clutch gear G106. As described above, the coupling gear G108 and the coupling gear G202 constitute the second coupling mechanism 352, and the second coupling mechanism 352 constitutes the connecting mechanism 350. In the connecting mechanism 350, when an operator pushes the storing-device body 202 that is at the position illustrated in FIG. 7 rearward to the position illustrated in FIG. 8, the coupling gear G202 is connected to the coupling gear G108, whereby the driving force generated by the motor 390 becomes ready to be transmitted to the moving mechanism 300.

In the second coupling mechanism 352, the coupling gear G202 and the coupling gear G108 each have a tapered surface that is inclined with respect to the direction of arrows a and the direction of arrow b. When the coupling gear G202 and the coupling gear G108 come to be connected to each other, the tapered surface of the coupling gear G202 is guided by the tapered surface of the coupling gear G108. Such a configuration suppresses the occurrence of a connection error between the coupling gear G202 and the coupling gear G108 due to any phase shift that may occur in a case where the second coupling mechanism 352 includes a pin and a groove that receives the pin.

The one-way-clutch gear G106 and the one-way-clutch gear G104 are integrated with each other and constitute a one-way clutch 452. The one-way clutch 452 constitutes the disallowing mechanism 450 described above. The one-way clutch 452 allows transmission of the rotational force from the one-way-clutch gear G104 to the one-way-clutch gear G106 but disallows transmission of the rotational force from the one-way-clutch gear G106 to the one-way-clutch gear G104. That is, the disallowing mechanism 450 allows transmission of the rotational force from the side of the motor 390 toward the side of the moving mechanism 300 but disallows transmission of the rotational force from the side of the moving mechanism 300 toward the side of the motor 390. The one-way-clutch gear G104 is in mesh with the gear G102. The driving force generated by the motor 390 is transmitted to the one-way-clutch gear G104 via the gear G102.

As described above, the disallowing mechanism 450 disallows transmission of the rotational force from the side of the moving mechanism 300 toward the side of the motor 390. Therefore, even if the motor 390 is stopped, the lifting member 302 stays at a position where the motor 390 is stopped, unless the connection disabling mechanism 400 disables the connection between the motor 390 and the moving mechanism 300.

Figure 10:
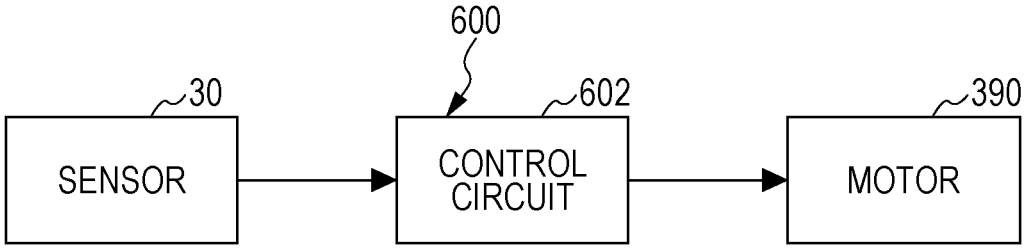
FIG. 10 is a block diagram of a control unit included in the image forming apparatus illustrated in FIG. 1.

FIG. 10 illustrates a control unit 600 included in the image forming apparatus 10. As illustrated in FIG. 10, the control unit 600 includes a control circuit 602 and controls the motor 390 in accordance with the input from the sensor 30. More specifically, the control unit 600 stops the motor 390 when the sensor 30 detects the contact of the top one of the sheets on the supporting member 210 with the pickup roller 154.

In the image forming apparatus 10 configured as described above, the motor 390 is stopped when the top one of the sheets on the supporting member 210 comes into contact with the pickup roller 154. Hence, there is no possibility that the stack of sheets may be excessively pressed against the pickup roller 154. However, the sensor 30 may cause a detection error. In that case, the motor 390 may fail to be stopped and the stack of sheets may be excessively pressed against the pickup roller 154.

In the state where the stack of sheets is excessively pressed against the pickup roller 154, the storing-device body 202 may be prevented from moving frontward even if the operator has pushed the storing-device body 202 rearward into the image-forming-apparatus body 12; the two pinching members 528 have released the projecting portion 204 of the storing-device body 202 (see FIG. 5A); and the urging member 502 has urged the storing-device body 202 frontward. To draw the storing-device body 202 out of the image-forming-apparatus body 12 in such a situation, the following process only needs to be performed: the connection between the moving mechanism 300 and the motor 390 is disabled, and the supporting member 210 is moved downward, so that the top one of the sheets is spaced apart from the pickup roller 154.

If the storing-device body 202 is provided with a handle on the outer side thereof, the supporting member 210 is able to be moved downward as follows: the storing-device body 202 is drawn out of the image-forming-apparatus body 12 by holding the handle, and the coupling gear G202 is thus spaced apart from the coupling gear G108, whereby the connection between the moving mechanism 300 and the motor 390 is disabled. However, the handle of the storing-device body 202 of the image forming apparatus 10 described above is not provided on the outer side of the storing-device body 202. Therefore, if the stack of sheets is excessively pressed against the pickup roller 154 while the storing-device body 202 is set in the image-forming-apparatus body 12, the storing-device body 202 may become unable to be drawn out of the image-forming-apparatus body 12.

Hence, the image forming apparatus 10 according to the exemplary embodiment includes the connection disabling mechanism 400 so that the connection between the moving mechanism 300 and the motor 390 is disabled by pushing the storing-device body 202 further into the image-forming-apparatus body 12, instead of drawing the storing-device body 202 out of the image-forming-apparatus body 12 by holding a handle. Thus, the top one of the sheets on the supporting member 210 is spaced apart from the pickup roller 154.

As described above, the present invention is applicable to image forming apparatuses such as a printer, a facsimile, and a copier and is also applicable to supplying devices that supply any supply objects such as a sheet.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a storing-device body that is drawable from an image-forming-apparatus body;

a supporting member attached to the storing-device body and that supports a stack of recording media from below;

a feeding member that feeds a top one of the recording media on the supporting member into the image-forming-apparatus body;

a moving mechanism that moves the supporting member such that the top one of the recording media on the supporting member comes into contact with the feeding member;

a connecting mechanism that connects the moving mechanism to a drive source in conjunction with attaching of the storing-device body to the image-forming-apparatus body;

an image forming section that forms an image on the recording medium fed by the feeding member; and a disabling mechanism that disables connection between the drive source and the moving mechanism after the storing-device body has been attached to the image-forming-apparatus body and in response to further pushing of the storing-device body into the image-forming-apparatus body.

2. The image forming apparatus according to claim 1, further comprising:

a disallowing mechanism that allows transmission of a rotational force from a side of the drive source toward a side of the moving mechanism but disallows transmission of the rotational force from the side of the moving mechanism toward the side of the drive source, wherein, in a state where the drive source is stopped, the disallowing mechanism stops the supporting member at a position where the top one of the recording media comes into contact with the feeding member.

3. The image forming apparatus according to claim 1, further comprising:

a pushing mechanism that pushes the storing-device body out of the image-forming-apparatus body, wherein the pushing mechanism pushes the storing-device body out of the image-forming-apparatus body in conjunction with pushing of the storing-device-body into the image-forming-apparatus body.

4. The image forming apparatus according to claim 1, further comprising:

a contact detecting device that detects contact of the top one of the recording medium on the supporting member with the feeding member; and a controller that controls at least the drive source, wherein the controller stops the drive source if the contact detecting device detects the contact of the top one of the recording medium on the supporting member with the feeding member.

5. The image forming apparatus according to claim 1, wherein the storing-device body includes a handle portion, and wherein the handle portion is provided at a position that is handleable only when the storing-device body is out of the image-forming-apparatus body.

6. A supplying device comprising:

a storing-device body that is drawable from an apparatus body;

a supporting member attached to the storing-device body and that supports a stack of supply objects from below;

a feeding member that feeds a top one of the supply objects on the supporting member into the apparatus body;

a moving mechanism that moves the supporting member such that the top one of the supply objects on the supporting member comes into contact with the feeding member;

a connecting mechanism that connects the moving mechanism to a drive source in conjunction with attaching of the storing-device body to the apparatus body; and a disabling mechanism that disables connection between the drive source and the moving mechanism after the storing-device body has been attached to the apparatus body and in response to further pushing of the storing-device body into the apparatus body.

* * * * *